United States Patent [19]

Hoeberechts

[11] 4,168,213

[45] Sep. 18, 1979

[54] FIELD EMISSION DEVICE AND METHOD OF FORMING SAME

[75] Inventor: Arthur M. E. Hoeberechts, Eindhoven, Netherlands

[73] Assignee: U.S. Philips Corporation, New York, N.Y.

[21] Appl. No.: 902,711

[22] Filed: May 4, 1978

Related U.S. Application Data

[62] Division of Ser. No. 780,963, Mar. 24, 1977, Pat. No. 4,095,133.

[30] Foreign Application Priority Data

Apr. 29, 1976 [NL] Netherlands ..... 7604569

[51] Int. Cl.[2] ..... C25D 5/02

[52] U.S. Cl. ..... 204/15; 156/659; 204/192 E

[58] Field of Search ..... 204/15, 192 E, 192 EC; 156/657, 659, 661, 662

[56] References Cited

U.S. PATENT DOCUMENTS

| | | | |
|---|---|---|---|
| 4,008,412 | 2/1977 | Yuito | 313/336 |
| 4,047,975 | 9/1977 | Widmann | 204/192 E |
| 4,052,269 | 10/1977 | Michel | 204/192 E |
| 4,117,301 | 9/1978 | Goel | 204/192 E |

*Primary Examiner*—T. M. Tufariello

*Attorney, Agent, or Firm*—Marc D. Schechter

[57] ABSTRACT

A field emission device and method of forming same, comprising a substrate on which at least one conical electrode is provided, which substrate, with the exception of the proximity of the tip of the electrode, is covered with a layer of a dielectric material on which a conductive layer is present at least locally, in which in order to form an integrated accelerating electrode the conductive layer extends in the direction of the punctiform tip of the electrode to beyond the dielectric layer and shows an aperture above the tip so that the conductive layer forms a cap-shaped accelerating electrode surrounding the conical electrode.

3 Claims, 7 Drawing Figures

FIELD EMISSION DEVICE AND METHOD OF FORMING SAME

Figure 1:
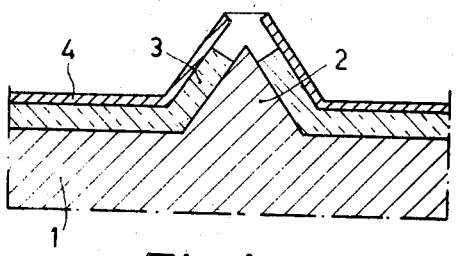

This is a division of application Ser. No. 780,963, filed Mar. 24, 1977 now U.S. Pat. No. 4,095,133.

The invention relates to a field emission device comprising a substrate on which at least one conical electrode is provided, which substrate, with the exception of the proximity of the tip of the electrode, is covered with a layer of dielectric material on which a conductive layer is present at least locally.

Such a field emission device is known from Netherlands patent application No. 73 01 833. In the known device the conductive layer terminates well below the tip of the electrode. It serves as a reflecting layer and an electric potential may also be applied to it to increase the electric field at the top of the electrode.

It is the object of the invention to provide a field emission device in which an accelerating electrode is integrated and in which the distance from the accelerating electrode to the electron emissive tip is extremely small. According to the invention this is achieved in that the conductive layer extends in the direction of the punctiform tip of the electrode to beyond the dielectric layer and shows an aperture above the tip so that the conductive layer forms a cap-shaped accelerating electrode surrounding the conical electrode.

Since the dielectric layer is very thin, the distance from the accelerating electrode to the tip of the conical electrode is extremely small. A relatively low electric voltage between the two then causes already a very high electric field strength which is desired for field emission. The construction of the integrated field emission device is simple and it occupies only very little space. It is therefore possible to form a large number of field emission devices in one substrate which, since they cooperate, require only a very small load per punctiform electrode.

The substrate and the conical electrode preferably consist of monocrystalline silicon, the dielectric layer consists of silicon dioxide and the conductive layer consists of polycrystalline silicon. Manufacturing methods may be used which have been developed in semiconductor devices in which extreme accuracy is possible. It has proved very advantageous when the monocrystalline silicon has a main face having a (100) crystal orientation, the punctiform electrode being formed by selective etching. It has surprisingly proved possible to etch a large number of emitters of entirely equal shape in the substrate.

The invention furthermore relates to a method of forming a field emission device from a substrate on which at least one conical electrode is formed. The method is essentially characterized in that the substrate having the conical electrode is provided with a layer of dielectric material, that a layer of a conductive material is provided over said layer, that at the area of the top of the conical electrode an aperture is formed in the conductive layer and that the dielectric layer around the top of the conical electrode and partly below the conductive layer at the area of the aperture is etched away by means of the conductive layer as a mask.

A very attractive method in which at least one conical electrode having a tip is formed on a substrate of monocrystalline silicon by covering the substrate with an island-shaped mask of silicon dioxide, an etching treatment of the substrate in which underetching below the mask occurs and then thermal oxidation of the substrate, is essentially characterized in that the thermal oxidation is continued until the tip of the conical electrode is present slightly below the island-shaped mask, that, while the mask remains present, a layer of polycrystalline silicon is provided over the oxide of the substrate and the island-shaped mask, that an aperture is etched in the polycrystalline silicon above the mask, said etching treatment being continued until the edge of the mask is reached, and that the island-shaped mask and also a silicon dioxide region which is present around the tip of the conical electrode are then etched away. A great advantage is that the treatments can be followed entirely by means of a microscope.

The invention will be described in greater detail with reference to the drawing.

In the drawing

Figure 2:
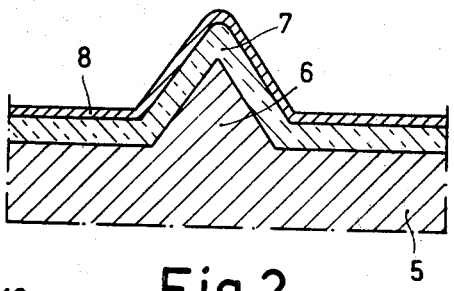
Figure 3:
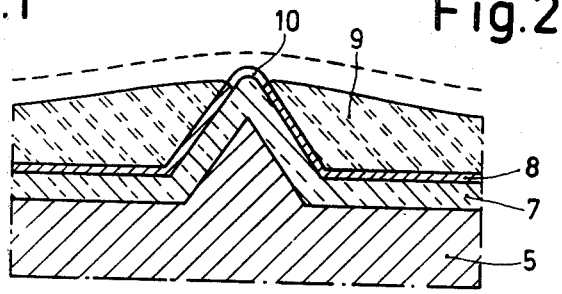
Figure 4:
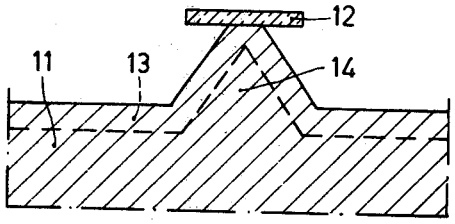
Figure 5:
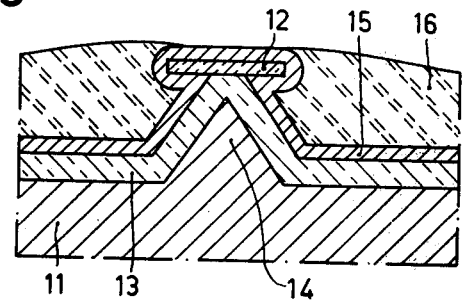
Figure 6:
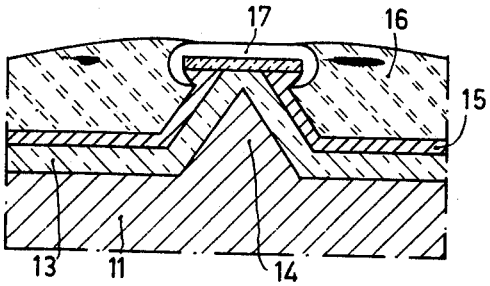
Figure 7:
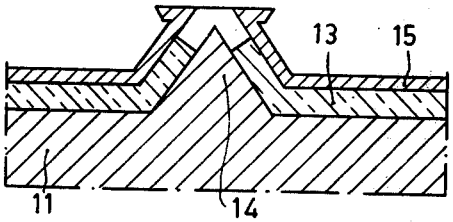

FIG. 1 shows an embodiment of a field emission device according to the invention, FIG. 2 shows a substrate having a punctiform electrode which is covered successively by an insulating layer and an electrically conductive layer, FIG. 3 shows the assembly shown in FIG. 2 in which after the provision of a photolacquer mask an aperture has been etched in the conductive layer, FIG. 4 shows the formation of the punctiform electrode in a further embodiment, FIGS. 5 and 6 show further stages in the embodiment shown in FIG. 4, and FIG. 7 shows a second embodiment of the field emission device.

FIG. 1 shows a field emission device according to the invention. A punctiform electrode 2 is formed in a substrate 1 which, at least near the main face shown, consists of a material suitable for field emission. The embodiment will be described with monocrystalline silicon as a substrate material. Present on the substrate is a layer 3 of dielectric material which does not cover the tip of the electrode 2. Said layer preferably consists of silicon oxide having a thickness of approximately 1 to 2 microns which, if desired, may be covered with a layer of silicon nitride of, for example, 0.04 micron thickness. Provided on the dielectric layer 3 is an accelerating electrode 4 which extends in the direction of the tip of the electrode 2 to beyond the dielectric layer and shows an aperture above the tip. The accelerating electrode may be, for example, a metal, for example, molybdenum, or polycrystalline silicon.

The field emission device shown has a simple construction. The integrated accelerating electrode 4 is positioned at an extremely short distance from the tip of the electrode 2. As a result of this, a strong electric field can be generated already with a comparatively low voltage difference, for example a few hundred volts, between the two, which field is necessary to obtain emission of electrons from the punctiform electrode. The emitted electrons move to the aperture in the accelerating electrode 4 towards the exterior. The field emission device may be accommodated in said discharge tube.

In practical applications, for example camera tubes, display tubes, grid microscopes and so on, a number of field emission devices manufactured in one substrate may be caused to cooperate so as to replace the thermal cathode, the load per punctiform electrode being only very small. The pitch distance will preferably be chosen to be not much larger than 15 microns and the height of the punctiform electrodes approximately 5 microns.

Furthermore, accelerating electrodes may be provided in paths and parts in the substrate may be insulated, for example by means of diffusions, in which each of the punctiform electrodes can operate separately or a number of them can operate collectively.

FIGS. 2 and 3 show successive steps in the manufacture of the field emission device. In this case also a specific embodiment is described, in which, for example, variations are possible in the material choice and the treatments to be carried out. FIG. 2 shows a substrate 5 in which a punctiform electrode 6 is formed which will serve as an emitter. The punctiform electrode may be formed by means of an etching method, approximately in a manner as is shown in FIG. 12 of Netherlands patent application 73 01 833. In a preferred embodiment according to the invention the substrate is monocrystalline silicon of the n-conductivity type having such a crystal orientation that the main face is a (100) face. For the formation of the electrode, etching may be carried out anisotropically, the removal of material in the (100) direction occurring more rapidly than in the (111) direction. A suitable etchant to achieve this is, for example, hydrazine at a temperature of 80° C. The result is that a conical highly facetted electrode is obtained having a rather large apex of approximately 70°. The radius of curvature of the tip of the punctiform electrode is a few hundred Angstroms and it has been found that in an electrode of (100) material a good emission is obtained. Furthermore, the shape of the tip can be reproduced very readily and notably the obtaining of the desired height of the punctiform electrode can be very readily controlled. In the simultaneous etching of a number of punctiform electrodes in the substrate a great uniformity of the electrodes is thus obtained.

The electrode 6 is covered with a dielectric layer 7. This can be achieved in a simple manner by thermal oxidation of the silicon substrate or by vapour deposition in which a thin layer of $SiO_2$ is formed, for example in a thickness of 1 to 2 microns. If desired, a thin layer of silicon nitride, thickness for example 0.04 micron, may be provided hereon, for example by vapour deposition, which inter alia has the advantage that the dielectric layer obtains a very high electric breakdown voltage. A conductive layer 8, for example of polycrystalline silicon in a thickness of approximately 0.5 micron, is provided on the dielectric layer 7.

The unit thus formed is now covered with a layer 9 of photolacquer. It is shown in FIG. 3 by means of a broken line that the layer of photolacquer after its provision extends to slightly above the top of the punctiform electrode. For example a thin flowing lacquer having a viscosity of approximately 20 centipoises is used. The layer of photolacquer is developed until the tip of the conductive layer 8 on the electrode 6 is released and the layer of photolacquer 9 is hardened by heating at approximately 80° C. This layer of photolacquer in which thus in a self-searching process and without further auxiliary means apertures are formed above the punctiform electrode, serves as a mask in the subsequent removal of the uncovered part of the conductive layer 8. It is shown in FIG. 3 that the non-shaded tip 10 of the conductive layer 8 has been etched away or sputtered away, which treatments are known per se from semiconductor manufacture. It will be obvious that the masking pattern of photolacquer can also be obtained by means of exposure of the layer of photolacquer via an extra mask. Due to the necessity of said extra mask said process is less attractive.

When the aperture 10 in the conductive layer 8 has been formed, the layer 9 of photolacquer may be removed. By means of an etching treatment in which the dielectric layer 7 is attacked but the conductive layer 8 and the electrode 6 are not attacked, the tip of the punctiform electrode 6 is released from dielectric and the shape shown in FIG. 1 is obtained; the conductive layer serves as an etching mask. If nitride is provided as an extra dielectric, the polycrystalline silicon should first be oxidized thermally so as to prevent attack of the silicon nitride layer by the etchant.

In a comparatively simple manner, a field emission device having an integrated accelerating electrode 8 is obtained which can be manufactured in a simple manner and in which, due to the very small distance between the top of the electrode 6 and the ends of the accelerating electrode 8, a very strong electric field between the two can be generated with a comparatively low voltage difference of, for example, a few hundred volts.

If during etching the aperture in the conductive layer 8 said aperture has become slightly larger than is desired for an optimum operation, the height of the cap-shaped part of electrode 8 can simply be increased and the aperture 6 reduced by means of electrolytic growing of layer 8.

As already noted, the invention is not restricted to silicon as a substrate material. Starting material may also be, for example, a composite material in which puntiform electrodes are formed. Furthermore, the dielectric layer may alternatively consist of a material other than those mentioned, for example aluminium oxide. In order to improve the emission properties, the emitter tip may be covered, if desired, with a layer of carbon or zirconium oxide. If desired, a dielectric layer may again be provided on the accelerating electrode and thereon a subsequent conductive layer which serves as a focusing electrode.

A very attractive further embodiment is shown in FIGS. 4 to 7. On a main face of a substrate of silicon having a (100) crystal orientation, an island-shaped mask 12, for example of silicon dioxide, is provided in known manner and a conical body is obtained below the mask 12 by an etching treatment (FIG. 4). In contrast with the known method, etching is carried out anisotropically in the (100) silicon used, as already described with reference to the embodiment shown in FIGS. 2 and 3. In this case, however, etching is continued only until a cone having a blunt tip is obtained which has a diameter of approximately 1.5 microns. The substrate is then oxidized thermally; the silicon dioxide layer 13 has a thickness of approximately 1 micron. A cone 14 having a sharp tip which is situated a few tenths of a micron below the island-shaped mask 12 is then formed below the oxide in the silicon.

A layer 15 of polycrystalline having a thickness of approximately 0.5 micron is then provided on the substrate surface and around the mask 12. Experiments have demonstrated that the layer 15 also grows particularly readily on the lower side of the mask 12. The layer 15 is shown in FIG. 5, as well as a layer 16 of photolacquer serving as a mask which is formed by means of the self-searching process described with reference to FIGS. 2 and 3. If desired, the layer 15 may be oxidized over a thickness of a few hundred Angstroms prior to providing the layer of photolacquer. The masking 16 enables the etching of an aperture 17 in the polycrystalline silicon (FIG. 6), etching being continued until the edge of the silicon dioxide mask 12 is reached. This etching process can be followed entirely by means of a microscope and can thus be controlled excellently, which makes this embodiment so attractive. As a matter of fact, due to the presence of the flat mask 12 the microscope can be adjusted to it, readjustment is by no means necessary and etching can be discontinued when the aperture has the desired size which is shown in FIG. 6.

As last step the mask 12 and also the silicon dioxide around the tip of the cone 14 are etched away. Etching is continued until the tip of the cone 14 is released approximately 2 microns. After removing the layer of photolacquer the integrated field emission device shown in FIG. 7 is obtained.

It is to be noted that the size of the aperture in the accelerating electrode 15 is determined by the diameter of the blunt tip of the cone 14 in the stage shown in FIG. 4. The aperture becomes positioned perfectly above the punctiform electrode; at that area the accelerating electrode is automatically situated slightly above the tip of electrode 14.

What is claimed is:

1. A method of forming a field emission device from a substrate on which at least one conical electrode is formed, characterized in that the substrate having the conical electrode is provided with a layer of dielectric material, that a layer of conductive material is provided over said layer, that at the area of the tip of the conical electrode an aperture is formed in the conductive layer and that the dielectric layer around the tip of the conical electrode and partly below the conductive layer at the area of the aperture is etched away by means of the conductive layer as a mask.

2. A method of forming a field emission device in which at least one conical electrode having a tip is formed on a substrate of monocrystalline silicon by covering the substrate with an island-shaped mask of silicon dioxide, an etching treatment of the substrate in which underetching below the mask occurs and then thermal oxidation of the substrate, characterized in that the thermal oxidation is continued until the tip of the conical electrode is situated slightly below the island-shaped mask, that, while the mask remains present, a layer of polycrystalline silicon is provided over the oxide of the substrate and the island-shaped mask, that an aperture is etched in the polycrystalline silicon above the mask, said etching treatment being continued until the edge of the mask is reached, and that the island-shaped mask and also a silicon dioxide region which is present around the tip of the conical electrode are then etched away.

3. A method as claimed in claim 1, characterized in that after the formation of an aperture in the conductive layer said aperture is reduced by electrolytic growing until the desired size.

* * * * *